US005616215A

United States Patent [19]

Heldt-Hansen et al.

[11] Patent Number: 5,616,215

[45] Date of Patent: Apr. 1, 1997

[54] METHOD OF MAKING PAPER FROM PULP TREATED WITH LIPASE AND AN ALUMINUM SALT

[75] Inventors: Hans P. Heldt-Hansen, Virum, Denmark; Yuko Fujita, Tokyo, Japan; Haruo Awaji, Saitama-ken, Japan; Hidesato Shimoto; Masaki Sharyou, both of Chiba-ken, Japan

[73] Assignee: Novo Nordisk A/S, Bagsvaerd, Denmark

[21] Appl. No.: 337,575

[22] Filed: Nov. 10, 1994

Related U.S. Application Data

[63] Continuation of Ser. No. 888,414, May 22, 1992, abandoned, which is a continuation of Ser. No. 687,813, Apr. 19, 1991, abandoned.

[51] Int. Cl.[6] ..... D21H 11/20

[52] U.S. Cl. ..... 162/72; 162/DIG. 4; 162/79; 435/198; 435/277; 435/278

[58] Field of Search ..... 162/72, DIG. 4, 162/79; 435/277, 278, 134, 198

[56] References Cited

U.S. PATENT DOCUMENTS

| | | | |
|---|---|---|---|
| 3,962,033 | 6/1976 | Eriksson et al. | 162/72 |
| 4,056,442 | 11/1977 | Huang | 435/198 |
| 5,037,508 | 8/1991 | Hyder | 162/DIG. 4 |
| 5,176,796 | 1/1993 | Irie et al. | 162/DIG. 4 |

FOREIGN PATENT DOCUMENTS

| | | | |
|---|---|---|---|
| 45822/89 | 6/1990 | Australia . | |
| 0351655 | 7/1989 | European Pat. Off. | 162/72 |
| 51-080305 | 7/1976 | Japan . | |
| 58-126794 | 7/1983 | Japan . | |
| 59-210893 | 11/1984 | Japan . | |
| 2176480 | 12/1986 | United Kingdom . | |
| WO88/02775 | 4/1988 | WIPO . | |

OTHER PUBLICATIONS

Matsukura et al, "Enzymatic Pitch Control in Papermaking System", *TAPPI Papermakers Conf.*, Apr. 23, 1990.

Hassler, "Pitch Deposition in Papermaking & the Function of Pitch Control Agents", *TAPPI J.*, Jun. 1988.

Hassler, "Pitch Deposition in Papermaking and the Function of Pitch Control Agents", TAPPI J. Jun. 1988 pp. 195–201.

Nishio et al., Agric. Biol. Chem. 51 (1), pp. 181–186 (1987).

Omar et al., Agric. Biol. Chem. 51 (1), pp. 37–45 (1987).

Linden et al., Intl. Symp. on Ethanol from Biomass, pp. 161–205 (presented Oct. 13–15, 1992).

Rughani et al., J. Wood Chem. and Tech., vol. 10, No. 4, pp. 515–530 (1990).

Irie et al., Papermakers Conference, Tappi Proceedings, pp. 1–10 Apr. 23–25 1990.

*Primary Examiner*—Steven Alvo

*Attorney, Agent, or Firm*—Steve T. Zelson, Esq.; Elias J. Lambiris, Esq.

[57] ABSTRACT

A process for hydrolysis of water-insoluble esters in the presence of a lipase, at a pH in the range of 3–7 particularly to such a process for hydrolysis of resin in pulp.

7 Claims, No Drawings

METHOD OF MAKING PAPER FROM PULP TREATED WITH LIPASE AND AN ALUMINUM SALT

This application is a continuation application of application Ser. No. 07/888,414, filed May 22, 1982, now abandoned which is a continuation application of application Ser. No. 07/687,813, filed on Apr. 19, 1991, now abandoned.

BACKGROUND OF THE INVENTION

1. Field of the Invention

This invention relates to a process for hydrolysis of water-insoluble esters in the presence of a lipase, at a pH in the range of 3–7 particularly to such a process for hydrolysis of resin in pulp.

2. Description of Related Art

It is known that lipases can be used with advantage for efficient hydrolysis of water-insoluble esters, particularly triglycerides, at acidic pH (e.g. JP-A 51-080305, JP-A 58-126794, JP-A 59-210893, GB-A 2,176,480, WO 88/02775).

It is also known that some types of pulp made from wood have a high pitch content, e.g. various types of mechanical pulp. This can cause so-called pitch troubles such as paper contamination or paper breaks. Pitch contains considerable amounts of triglycerides, more commonly known as fats, and other esters.

It is the object of this invention to provide an improved process for ester hydrolysis, applicable to hydrolysis of resin esters.

SUMMARY OF THE INVENTION

We have found that, surprisingly, addition of an aluminum salt significantly increases the hydrolysis rate of esters in the presence of lipases at acidic pH. A strong increase of fat hydrolysis (from c. 50% to c. 87% hydrolysis) was found with as little as 10 μM $Al^{+++}$.

T. Nishio et al., Agric. Biol. Chem., 51 (1), 181–186, 1987, in Table II shows that the activity of lipase from Pseudomonas fragi at pH of 9.0 is lowered to 94% by incubation with $1\times10^3$M of $Al^{3+}$. In contrast to this, we have surprisingly found significant increase of lipase activity by the addition of lower concentrations of $Al^{+++}$at acidic pH.

Accordingly, the invention provides a process for hydrolysis of water-insoluble esters in the presence of a lipase at a pH in the range of 3–7, characterized by the presence of an aluminum salt. A particular embodiment of the invention provides such a process for the hydrolysis of resin in pulp.

DETAILED DESCRIPTION OF THE INVENTION

Process conditions

Typical process conditions are pH of 3–6, particularly 4–5.5, a temperature from ambient to 70° C., particularly 30°–60° C., and reaction times of 0.5–3 hours.

For reasons of economy, microbial lipases are preferred. Examples of suitable enzymes are lipases derived from strains of Pseudomonas (especially *Ps. cepacia, Ps. fluorescens, Ps. fragi* and *Ps. stutzeri*), Candida (especially *C. antarctica* (e.g. lipase A or B, see WO 88/02775) and *C. cylindracea*), Humicola (especially *H. brevispora, H. lanuginosa, H. brevis* var. thermoidea and *H. insolens*), Chromobacterium (especially *C. viscosum*) and Aspergillus (especially *A. niger*).

The amount of lipase will typically correspond to a lipase activity of 1,000–100,000 LU/kg dry matter or 50–5,000 LU/litre (LU=Lipase Unit, defined in WO 89/04361).

The aluminum salt used in the invention may be any salt that is soluble at the conditions of the process. Conveniently, aluminum sulfate or aluminum chloride can be used.

A suitable concentration for achieving increased hydrolysis rate is 1–50 mM as $Al^{+++}$, preferably 2–20 mM.

Ester hydrolysis

The process of the invention can be used for any lipase-catalyzed hydrolysis of water-insoluble esters, particularly triglycerides.

Thus, the process of the invention may be used for fat hydrolysis in the production of fatty acids, glycerides and/or glycerol from fat or oil. This may be a liquid at ambient temperature, such as soy bean oil and many other oils, or it may be a high melting fat, such as beef tallow.

Hydrolysis of resin esters

The process of the invention is particularly applicable to the hydrolysis of resin esters during a pulping or paper-making process, e.g. to avoid pitch troubles such as paper contamination or paper breaks.

The process of the invention may be applied to any pitch-containing pulp, especially to pulps with a considerable content of triglycerides and other esters from pitch. Examples are pulps produced by mechanical pulping, alone or combined with a gentle chemical treatment, such as GW (Ground Wood), TMP (Thermo Mechanical Pulp) and CTMP (Chemical Thermo Mechanical Pulp).

Hydrolysis of esters in pitch according to the invention can be done in the pulping or stock preparation section, where addition of aluminum sulfate (alum) is particularly advantageous since it can also act as a retention or flocculation aid. The pulp typically has a consistency of 0.2–5% dry substance.

To avoid break-down of the fibre structure in the pulp, cellulase side-activities should be essentially absent, preferably below 1000 EGU/kg of pulp dry matter. Cellulase activity in EGU units is determined as follows:

A substrate solution is prepared, containing 34.0 g/l CMC (Hercules 7 LFD) in 0.1 M phosphate buffer at pH 6.0. The enzyme sample to be analyzed is dissolved in the same buffer. 5 ml substrate solution and 0.15 ml enzyme solution are mixed and transferred to a vibration viscosimeter (e.g. MIVI 3000 from Sofraser, France), thermostated at 40° C. One Endo-Glucanase Unit (EGU) is defined as the amount of enzyme that reduces the viscosity to one half under these conditions. The amount of enzyme sample should be adjusted to provide 0.01–0.02 EGU/ml in the reaction mixture.

EXAMPLE 1

Effect of various $Al^{+++}$concentrations

Ground wood pulp was treated with Humicola lipase in the presence of varying amounts of aluminum sulfate. After the reaction, the degree of hydrolysis was determined by quantitative TLC using Iatroscan™.

Conditions were 4.0% pulp slurry, pH 4.5, 40° C., 2 hours reaction time and an enzyme dosage of 60 LU/g. The dosage of aluminum salt ($Al_2(SO_4)3$) is given in % w/w of dry pulp. The results are as follows:

| % $Al_2(SO_4)_3$ | % hydrolysis |
|---|---|
| 0.0 | 50.3 |
| 0.5 | 73.2 |
| 2.5 | 87.0 |
| 3.0 | 85.6 |
| 6.0 | 100.0 |
| 30.75 | 90.5 |
| 64.0 | 96.7 |

These results demonstrate an increasing hydrolysis rate up to an aluminum dosage of about 6% relative to dry matter, i.e. up to about 2.5 g/l or about 10 mM as $Al^{+++}$.

EXAMPLE 2

A number of different microbial lipases were tested in the same manner as in Example 1 using 0 and 6% $Al_2(SO_4)_3$ (approx. 2.5 g/l or 10 mM $Al^{+++}$). The dosage of each lipase was adjusted so as to obtain a comparable degree of hydrolysis in each experiment without $Al^{+++}$. The results (% hydrolysis) are as follows:

| Origin of lipase | Without $Al^{+++}$ | With $Al^{+++}$ |
|---|---|---|
| *Humicola lanuginosa* | 56.5 | 78.8 |
| *Candida cylindracea* | 66.1 | 82.6 |
| *Candida cylindracea* (lower dosage) | 47.6 | 79.6 |
| *Candida antarctica* lipase A | 60.5 | 96.4 |
| *Pseudomonas cepacia* | 59.7 | 94.2 |

A strong activation of the lipase effect is seen with all lipases tested, both of yeast and bacterial origin.

We claim:

1. A process for making paper, comprising (a) treating a pulp which contains pitch with a lipase in the presence of an aluminum salt at a PH in the range of 3–7 to hydrolyze esters in the pitch, wherein the concentration of the aluminum salt is 1–50 mM, the activity of the lipase is 1–100 KLU/kg of dry matter and the amount of hydrolysis is greater than the amount of hydrolysis with the lipase alone, and (b) making the paper from the treated pulp.

2. The process according to claim 1, wherein the esters are triglycerides.

3. The process according to claim 1, wherein the aluminum salt is chloride or aluminum sulfate.

4. The process according to claim 1, wherein the hydrolysis takes place at a temperature in the range of 30°–700° C.

5. The process according to claim 1, wherein the pH is in the range of 4.0–5.5.

6. The process according to claim 1, wherein the pulp is produced by mechanical pulping.

7. The process according to claim 1, wherein the cellulase activity is below 1000 EGU/kg.

* * * * *